United States Patent [19]

Yamagishi et al.

[11] Patent Number: 5,050,886

[45] Date of Patent: Sep. 24, 1991

[54] GOLF BALL

[75] Inventors: Katsunobu Yamagishi; Yasuhiro Fukui, both of Kagawa, Japan

[73] Assignee: Kamatari Co., Ltd., Japan

[21] Appl. No.: 591,041

[22] Filed: Oct. 1, 1990

[30] Foreign Application Priority Data

Oct. 23, 1989 [JP] Japan ..... 1-276466

[51] Int. Cl.[5] ..... A63B 37/06

[52] U.S. Cl. ..... 273/220; 273/230

[58] Field of Search ..... 273/62, 220, 218, 230, 273/221, 213, 214, 63 R

[56] References Cited

U.S. PATENT DOCUMENTS

| | | | |
|---|---|---|---|
| 711,529 | 10/1902 | Richards | 273/230 X |
| 1,369,868 | 3/1921 | Worthington | 273/230 X |
| 3,807,733 | 4/1974 | Dearmont | 273/63 R |

*Primary Examiner*—George J. Marlo

*Attorney, Agent, or Firm*—Lorusso & Loud

[57] ABSTRACT

A golf ball is disclosed, which comprises a core and a shell surrounding said core, said core composed of (a) a matrix formed of a first, relatively hard rubber and (b) a multiplicity of particles dispersed in said matrix and accounting for 10–65% of the volume of said core, said particles being formed of a second, relatively soft rubber and having a particle size of greater than 0.8 mm but not greater than 7.0 mm. This golf ball provides long carry and distance and gives hands a soft strike shock.

5 Claims, 1 Drawing Sheet

GOLF BALL

BACKGROUND OF THE INVENTION

1. Field of the Invention

The present invention relates to a golf ball which allows a striker to hit the ball farther and which gives him a more congenial strike shock.

2. Description of Prior Art

Golf balls used in the game at present include thread-wound balls and solid balls which include two-piece balls.

Although some profesional golfers and higher-grade amateur golfers use only thread-wound balls, a majority of golfers prefer two-piece balls due to their better durability and longer carry and distance.

However, the two-piece balls give hands a bad strike shock due to the high hardness thereof, particularly upon hitting off the sweet spot of a golf club head.

Two-piece balls having a softer core, developed to reduce strike shock, have such poor repulsion that they fail to provide enough carry and distance. This poor repulsion can not be supplemented by improvement of ball shell.

With a view toward removing the above defects, three-piece structure solid balls have recently been developed which comprise a two-layer core composed of a softer inner core and a harder outer core covered by a shell. The three-piece balls provide longer carry and distance and a better strike shock, but are still insufficient.

SUMMARY OF THE INVENTION

An object of the present invention is to provide a two-piece golf ball which has an improved core structure and which gives hands a soft shock upon hitting without spoiling long carry and distance.

In accomplising the foregoing object, there is provided a golf ball comprising: a core composed of (a) a matrix formed of a first, relatively hard rubber having a Shore D hardness of 55–70 and (b) a multiplicity of particles dispersed in said matrix and accounting for 10–65%, preferably 25–50%, of the volume of said core, said particles being formed of a second, relatively soft rubber having a Shore D hardness of 15–50 and having a particle size of greater than 0.8 mm but not greater than 7.0 mm, and said core requiring a load of 250–550 kg for being deformed by pressing to such a degree that the diameter thereof is reduced by 10 mm in the pressing direction; and a shell surrounding said core.

Other objects, features and advantages of the present invention will become apparent from the detailed description of the invention to follow.

BRIEF DESCRIPTION OF THE INVENTION

FIG. 1 is a cross sectional view of a golf ball in accordance with the present invention wherein:

1 designates a shell;

2 designates a core;

3 designates a relatively hard rubber matrix; and

4 designates particles of a relatively soft rubber dispersed in said matrix.

DETAILED DESCRIPTION OF THE INVENTION

Figure 1:
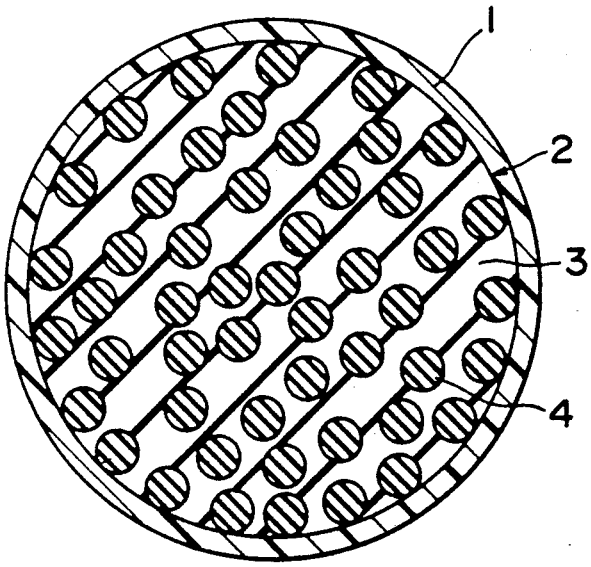

The relatively hard rubber ensures long carry and distance, whereas the relatively soft particulate rubber serves to give hands less shock upon hitting. The relatively soft particulate rubber accounts for 10–65% of the volume of said core. If less than 10 %, there results almost the same strike shock as with the conventional two-piece golf balls, whereas if more than 65%, the result is insufficient core strength and a poor durability of the ball.

A smaller load required for deforming the core by pressing to such a degree that the diameter thereof is reduced by 10 mm in the pressing direction means less core hardness. However, if less than 250 kg, the result is poor repulsion and shorter carry and distance, of the ball, whereas if more than 550 kg, the result is excessive hardness giving hands unpleasant strike shock.

The golf ball of the present invention is described in more detail below.

The golf ball of the present invention has a core constituted of a relatively hard matrix rubber and a multiplicity of particles of a relatively soft rubber, with both rubbers being formed of compositions mainly comprising a natural rubber and/or a synthetic rubber having conventionally been used for two-piece golf balls. For example, such composition is prepared by compounding cis-1,4-polybutadiene with zinc acrylate, zinc oxide, an organic peroxide, an aging inhibitor, etc. In general, the relatively hard rubber and the relatively soft particulate rubber are the same in rubber composition, though they may be properly altered.

The relatively hard rubber has a Shore D hardness of 55–70, preferably 60–65. If less than 55, the resulting golf ball fails to achieve sufficient repulsion, gives too soft a strike shock and causes short carry. On the other hand, if more than 70, an excessively hard ball results, giving hands a bad strike shock.

The relatively soft particulate rubber has a Shore D hardness of 15–50, preferably 30–45. If less than 15, a golf ball gives short carry, whereas if more than 50, a golf ball gives hands a bad strike shock. As to particle size, the particulate soft rubber has a particle size (diameter of imaginary spheres for the particles) of greater than 0.8 mm but not greater than 7.0 mm, preferably 2.0–5.0 mm in average particle size. Powdery rubber of less than 0.8 mm in size fails to provide the effects of the present invention. Particulate rubber of more than 7.0 mm in size provides too low a core strength for the golf ball to be practically used. The particles of the relatively soft rubber may be different from each other in hardness, size and form and, preferably, two or three kinds of particles are mixed to use.

As the shell for covering said core, conventionally used ones may be used. For example, ionomer resins are used in a thickness of 1–3 mm.

The present invention is now illustrated in greater detail by reference to the following examples and comparative examples which, however, are not to be construed as limiting the present invention in any way.

EXAMPLES 1 TO 6 AND COMPARATIVE EXAMPLES 1 to 6

Relatively soft particulate rubbers No.1 to No.7 were prepared from the compositions of the formulations shown in Table 1. Cores of 38.3 mm in diameter were formed from the seven relatively soft particulate rubbers and compositions for the relatively hard rubber having the formulations shown in Table 2. Total volumes of the relatively soft rubber particles based on the volume of the cores are shown in Table 2. Each of the cores was coated with a resin containing an ionomer resin (e.g., Mitusi-du Pont Chemical Co., Ltd., Japan, Hi-Milan 1706) as a major component to obtain golf balls of 42.7 mm in diameter for Examples 1 to 6 and Comparative Examples 1 to 6. Carry, distance and strike shock of each golf ball were examined and shown in Table 2. Carry and distance were measured using a swing robot (made by True Temper Sports Inc, U.S.A.) and a wood club driver (43 inches; loft: 11°, swing ballance: $D_0$) at a head speed of 43 m/s. Strike shock was evaluated by male higher-grade golfers at a head speed of about 45 m/s and about 40 m/s.

As is shown in Table 2, golf balls of Examples 1-6 respectively using cores containing a multiplicity of particles of the relatively soft rubber in contents of 10-65% of the volume of said cores and requiring a load of 250-550 kg for being deformed by pressing to such a degree that the diameter thereof is reduced by 10 mm provided long carry and a good strike shock. Golf ball of Example 2 gave the best effect. This golf ball had a core of 30 % in the total volume of the soft particles based on the volume of the core and 454 kg in the load required for deforming the core to such a degree that the diameter thereof is reduced by 10 mm. The particulate relatively soft rubber used for the golf ball had a Shore D hardness of 35, and an average particle size of 3.0 mm, whereas the relatively hard rubber had a Shore D hardness of 64.

Golf balls of Comparative Examples 1 and 2 had poor strength since the content of the particulate relatively soft rubber exceeded 65 %. On the other hand, golf ball of Comparative Example 3 provided an unpleasant strike shock though it gave long carry, since the content of the particulate relatively soft rubber is less than 10 %.

Golf balls of Comparative Examples 4 and 5 provided insufficient carrY since the load required for deforming the core to such a degree that the diameter thereof is reduced by 10 mm was less than 250 kg. On the other hand, golf ball of Comparative Example 6 gave an unpleasant strike shock since the load required for deforming the core to such a degree that the diameter thereof is reduced by 10 mm was more than 550 kg.

EXAMPLES 7 TO 10 AND COMPARATIVE EXAMPLES 7 TO 12

Golf balls of Examples 7 to 10 and Comparative Examples 7 to 12 were obtained by using core materials shown in Table 3 for both the relatively soft rubber and the relatively hard rubber) in amounts also shown in the table, then covering the cores with a resin.

COMPARATIVE EXAMPLE 13

Golf ball of Comparative Example 13 is a golf ball of a conventional two-piece structure.

Golf balls of Examples 7 to 10 and Comparative Examples 7 to 13 were subjected to the same measurement of carry and evaluation of strike shock as with the golf balls of Examples 1 to 6 and Comparative Examples 1 to 6. The results thus obtained are shown in Table 3.

TABLE 1

| | No. 1 | No. 2 | No. 3 | No. 4 | No. 5 | No. 6 | No. 7 |
|---|---|---|---|---|---|---|---|
| Composition | | | | | | | |
| cis-1,4-polybutadiene*1 (parts) | 100 | 100 | 100 | 100 | 100 | 100 | 100 |
| zinc acrylate*2 (parts) | 5 | 13 | 20 | 20 | 3 | 31 | 20 |
| zinc oxide*3 (parts) | 24 | 21 | 19 | 19 | 25 | 14 | 19 |
| organic peroxide*4 (parts) | 2.8 | 2.8 | 2.8 | 2.8 | 2.8 | 2.8 | 2.8 |
| aging inhibitor*5 (parts) | 0.5 | 0.5 | 0.5 | 0.5 | 0.5 | 0.5 | 0.5 |
| Hardness (Shore D) | 17 | 35 | 44 | 48 | 13 | 53 | 44 |
| Diameter (mm) | 4.0 | 3.0 | 6.5 | 4.0 | 4.0 | 4.0 | 7.5 |

*1BR11 made by Japan Synthetic Rubber Co., Ltd.
*2ZN-DA90S made by Japan Catalytic Chemical Industry Co., Ltd.
*3Zinc White #3 made by Hakusui Chemical Industry Co., Ltd.
*4Perhexa 3M-40 made by Nippon Oils & fats Co., Ltd.
*5Sandant 425 made by Sanshin Chemical Industry Co., Ltd.

TABLE 2 (1)

| | | Examples | | | | | |
|---|---|---|---|---|---|---|---|
| | | 1 | 2 | 3 | 4 | 5 | 6 |
| Particulate Rubber (No.) | | No. 1 | No. 2 | No. 3 | No. 4 | No. 1 | No. 2 |
| Hard Rubber | Composition | | | | | | |
| | cis-1,4-polybutadiene (parts) | 100 | 100 | 100 | 100 | 100 | 100 |
| | zinc acrylate (") | 33 | 36 | 36 | 33 | 33 | 36 |
| | zinc oxide (") | 19 | 18 | 18 | 20 | 21 | 17 |
| | organic peroxide (") | 2.8 | 2.8 | 2.8 | 2.8 | 2.8 | 2.8 |
| | aging inhibitor (") | 0.5 | 0.5 | 0.5 | 0.5 | 0.5 | 0.5 |
| | Hardness (Shore D) | 60 | 64 | 67 | 61 | 60 | 65 |
| Core | (Total volume of particulate rubber × 100/Core volume (%) | 30 | 30 | 20 | 52 | 64 | 12 |
| Properties | Load required for deforming to reduce diameter by 10 mm (Kg) | 302 | 454 | 497 | 398 | 272 | 531 |
| | Strength | 95 | 100 | 95 | 90 | 90 | 100 |
| Ball | Carry (m) | 188.7 | 189.6 | 190.1 | 189.3 | 188.6 | 190.4 |
| | Distance (m) | 198.9 | 199.4 | 200.0 | 199.6 | 198.8 | 200.2 |
| properties | Strike shock | | | | | | |
| | Head speed 45 m/s | A | A | A | A | B | B |
| | Head speed 40 m/s | A | A | B | A | A | B |

TABLE 2 (2)

| | | Comparative Examples | | | | | |
|---|---|---|---|---|---|---|---|
| | | 1 | 2 | 3 | 4 | 5 | 6 |
| Particulate Rubber (No.) | | No. 1 | No. 2 | No. 2 | No. 1 | No. 4 | No. 4 |
| Hard Rubber | Composition | | | | | | |
| | cis-1,4-polybutadiene (parts) | 100 | 100 | 100 | 100 | 100 | 100 |
| | zinc acrylate (") | 33 | 33 | 36 | 31 | 31 | 36 |
| | zinc oxide (") | 21 | 21 | 17 | 20 | 20 | 17 |
| | organic peroxide (") | 2.8 | 2.8 | 2.8 | 2.8 | 2.8 | 2.8 |
| | aging inhibitor (") | 0.5 | 0.5 | 0.5 | 0.5 | 0.5 | 0.5 |
| | Hardness (Shore D) | 61 | 61 | 65 | 56 | 56 | 67 |
| Core | (Total volume of particulate rubber × 100/Core volume (%) | 68 | 75 | 8 | 60 | 62 | 13 |
| Properties | Load required for deforming to reduce diameter by 10 mm (Kg) | 266 | 257 | 556 | 223 | 248 | 585 |
| | Strength | 80 | 75 | 100 | 85 | 80 | 100 |
| Ball | Carry (m) | 188.1 | 187.7 | 190.7 | 185.1 | 186.3 | 191.2 |
| | Distance (m) | 198.5 | 198.0 | 200.6 | 195.1 | 196.5 | 200.9 |
| properties | Strike shock | | | | | | |
| | Head speed 45 m/s | B | B | C | B | B | D |
| | Head speed 40 m/s | A | A | D | B | B | D |

TABLE 3 (1)

| | | Examples | | | | Comp. Ex. |
|---|---|---|---|---|---|---|
| | | 7 | 8 | 9 | 10 | 7 |
| Particulate Rubber (No.) | | No. 1 | No. 2 | No. 3 | No. 4 | No. 5 |
| Hard Rubber | Composition | | | | | |
| | cis-1,4-polybutadiene (parts) | 100 | 100 | 100 | 100 | 100 |
| | zinc acrylate (") | 36 | 31 | 36 | 31 | 33 |
| | zinc oxide (") | 18 | 19 | 18 | 19 | 19 |
| | organic peroxide (") | 2.8 | 2.8 | 2.8 | 2.8 | 2.8 |
| | aging inhibitor (") | 0.5 | 0.5 | 0.5 | 0.5 | 0.5 |
| | Hardness (Shore D) | 67 | 56 | 68 | 57 | 62 |
| Core | (Total volume of particulate rubber × 100/Core volume (%) | 48 | 25 | 45 | 13 | 30 |
| Properties | Load required for deforming to reduce diameter by 10 mm (Kg) | 346 | 430 | 468 | 491 | 259 |
| | Strength | 90 | 95 | 90 | 95 | 95 |
| Ball | Carry (m) | 189.0 | 189.5 | 189.9 | 189.9 | 187.9 |
| | Distance (m) | 199.6 | 199.4 | 200.3 | 200.1 | 198.0 |
| properties | Strike shock | | | | | |
| | Head speed 45 m/s | A | A | A | A | B |
| | Head speed 40 m/s | A | A | A | B | B |

TABLE 3 (2)

| | | Comparative Examples | | | | | |
|---|---|---|---|---|---|---|---|
| | | 8 | 9 | 10 | 11 | 12 | |
| Particulate Rubber (No.) | | No. 6 | No. 2 | No. 3 | No. 7 | No. 7 | 13 |
| Hard Rubber | Composition | | | | | | |
| | cis-1,4-polybutadiene (parts) | 100 | 100 | 100 | 100 | 100 | 100 |
| | zinc acrylate (") | 33 | 31 | 40 | 36 | 36 | 33 |
| | zinc oxide (") | 19 | 20 | 16 | 18 | 18 | 17 |
| | organic peroxide (") | 2.8 | 2.8 | 2.8 | 2.8 | 2.8 | 2.8 |
| | aging inhibitor (") | 0.5 | 0.5 | 0.5 | 0.5 | 0.5 | 0.5 |
| | Hardness (Shore D) | 62 | 52 | 73 | 64 | 68 | 61 |
| Core | (Total volume of particulate rubber × 100/Core volume (%) | 30 | 30 | 30 | 30 | 47 | |

TABLE 3 (2)-continued

| | | Comparative Examples | | | | | |
|---|---|---|---|---|---|---|---|
| | | 8 | 9 | 10 | 11 | 12 | |
| Particulate Rubber (No.) | | No. 6 | No. 2 | No. 3 | No. 7 | No. 7 | 13 |
| Properties | Load required for deforming to reduce diameter by 10 mm (Kg) | 539 | 252 | 543 | 477 | 474 | 552 |
| | Strength | 95 | 90 | 100 | 80 | 85 | 100 |
| Ball properties | Carry (m) | 190.5 | 186.3 | 190.7 | 190.1 | 189.9 | 200.1 |
| | Distance (m) | 200.2 | 196.8 | 200.6 | 199.8 | 199.7 | 200.1 |
| | Strike shock | | | | | | |
| | Head speed 45 m/s | B | B | C | A | A | C |
| | Head speed 40 m/s | C | B | D | A | A | D |

In the above tables, "load required for deforming to reduce diameter by 10 mm (Kg)" was determined by measuring a load required for deforming the core by pressing to such a degree that the diameter thereof was reduced by 10 mm in the pressing direction using a load cell.

"Strength" was determined by measuring a strength at break by pressure, and was presented as a relative value taking the value of the core of Comparative Example 13 (conventional two-piece ball) as 100.

Strike shock was scored by golfers according to the following rating:

A very good
B good
C somewhat bad
D bad

While the present invention has been described in detail and with reference to specific embodiments thereof, it is apparent those experienced in this field that various changes and modifications can be made therein without departing from the spirit and the scope of the present invention.

What is claimed is:

1. A golf ball comprising:

a core composed of (a) a matrix formed of a first, relatively hard rubber having a Shore D hardness of 55–70,and (b) a multiplicity of particles dispersed in said matrix and accounting for 10–65% of the volume of said core, said particles being formed of a second, relatively soft rubber having a Shore D hardness of 15–50 and having a particle size of greater than 0.8 mm but not greater than 7.0 mm, and said core requiring a load of 250–550 kg for being deformed by pressing to such a degree that the diameter thereof is reduced by 10 mm in the pressing direction; and a shell surrounding said core to provide a gold ball which may be driven a long distance by a golfer without exhibiting unpleasant shock on hitting.

2. A golf ball as set forth in claim 1, wherein said first relatively hard rubber has a Shore D hardness of 60–65.

3. A golf ball as set forth in claim 1, wherein said particles account for 25–50% of the volume of said core.

4. A golf ball as set forth in claim 1, wherein said particles have a Shore D hardness of 30–45.

5. A golf ball as set forth in claim 1, wherein said particles have an average particle size of 2–5 mm.

* * * * *